US012180793B2

(12) United States Patent
Cavanagh et al.

(10) Patent No.: US 12,180,793 B2
(45) Date of Patent: Dec. 31, 2024

(54) OPEN WATER RECOVERY SYSTEM AND METHOD

(71) Applicant: Baker Hughes Energy Technology UK Limited, Bristol (GB)

(72) Inventors: Jack James Cavanagh, Montrose (GB); Mark John Jamieson, St Cyrus (GB)

(73) Assignee: Baker Hughes Energy Technology UK Limited (GB)

( * ) Notice: Subject to any disclaimer, the term of this patent is extended or adjusted under 35 U.S.C. 154(b) by 0 days.

(21) Appl. No.: 18/081,981

(22) Filed: Dec. 15, 2022

(65) Prior Publication Data

US 2023/0193710 A1 Jun. 22, 2023

Related U.S. Application Data

(60) Provisional application No. 63/290,421, filed on Dec. 16, 2021.

(51) Int. Cl.
*E21B 23/00* (2006.01)
*E21B 33/04* (2006.01)
*E21B 33/068* (2006.01)

(52) U.S. Cl.
CPC ..... *E21B 23/00* (2013.01); *E21B 33/0422* (2013.01); *E21B 33/068* (2013.01)

(58) Field of Classification Search
CPC ..... E21B 23/00; E21B 33/068; E21B 33/076
See application file for complete search history.

(56) References Cited

U.S. PATENT DOCUMENTS 3,693,714 A * 9/1972 Baugh ..... E21B 33/047 166/348
4,067,062 A * 1/1978 Baugh ..... E21B 23/04 166/212
4,736,799 A * 4/1988 Ahlstone ..... E21B 33/047 166/182
4,969,519 A 11/1990 Kelly
6,470,968 B1 * 10/2002 Turner ..... E21B 33/043 166/341
9,435,164 B2 * 9/2016 Fenwick ..... E21B 23/00
10,472,914 B2 * 11/2019 Nguyen ..... E21B 33/068
(Continued)

FOREIGN PATENT DOCUMENTS

WO WO-2018107095 A2 * 6/2018 ..... E21B 19/06
WO WO-2020264414 A1 * 12/2020
WO 2022/177444 A1 8/2022

OTHER PUBLICATIONS

International Search Report and Written Opinion issued May 9, 2023 in PCT Application No. PCT/EP2022/025578.

*Primary Examiner* — Matthew R Buck
(74) *Attorney, Agent, or Firm* — Baker Hughes Patent Organization

(57) ABSTRACT

A wellbore system includes an upper body, a lower body, removably coupled to the upper body, and a passage extending through both the upper body and the lower body, the passage being aligned and extending through an interface between the upper body and the lower body. The wellbore system also includes a latch piston, confined to the lower body, the latch piston being moveable responsive to an applied pressure via the passage. The wellbore system further includes a latch piston retaining ring, confined to the lower body.

17 Claims, 16 Drawing Sheets

(56) References Cited

U.S. PATENT DOCUMENTS

| | | | |
|---|---|---|---|
| 2016/0177652 | A1 | 6/2016 | Thornburrow |
| 2018/0100364 | A1 | 4/2018 | Nguyen |
| 2018/0179839 | A1 | 6/2018 | Nguyen |
| 2018/0187502 | A1 | 7/2018 | Cridland et al. |
| 2018/0258726 | A1 | 9/2018 | Levert, Jr. et al. |
| 2018/0258727 | A1 | 9/2018 | Lim et al. |

* cited by examiner

OPEN WATER RECOVERY SYSTEM AND METHOD

CROSS-REFERENCE TO RELATED APPLICATIONS

This application claims priority to and the benefit of U.S. Provisional Patent Application No. 63/290,041, titled "TUBING HANGER OPEN WATER RECOVERY SYSTEM AND METHOD," filed Dec. 16, 2021, the full disclosure of which is hereby incorporated by reference, in its entirety, for all purposes.

BACKGROUND

1. Field of Disclosure

This disclosure relates in general to oil and gas tools, and in particular, to systems and methods for retrieval and/or recovery of various wellbore components.

2. Description of the Prior Art

In exploration and production of formation minerals, such as oil and gas, wellbores may be drilled into an underground formation. The wellbores may include various drilling, completion, or exploration components, such as hangers or sealing systems that may be arranged in a downhole portion or at a surface location. Toward an end of a well life, various components are removed from the wellbore and the wellbore may be plugged, which may be referred to as a plug and abandon operation. In offshore conditions, this may require large rigs or ships, which increase costs for operators.

SUMMARY

Applicants recognized the problems noted above herein and conceived and developed embodiments of systems and methods, according to the present disclosure, for wellbore operations.

In an embodiment, a wellbore system includes an upper body, a lower body, removably coupled to the upper body, and a passage extending through both the upper body and the lower body, the passage being aligned and extending through an interface between the upper body and the lower body. The wellbore system also includes a latch piston, confined to the lower body, the latch piston being moveable responsive to an applied pressure via the passage. The wellbore system further includes a latch piston retaining ring, confined to the lower body.

In an embodiment, a wellbore tool kit includes an upper body having a first passage extending from a first end to second end. The wellbore tool kit also includes a lower body having a second passage extending axially from a top end to a piston chamber. The lower body further includes one or more gripping components, the gripping component being movable responsive to a pressure applied via the first passage and the second passage. The lower body also includes one or more gripping component retainers. The upper body is removably coupled to the lower body such that an interface is formed between the second end and the top end, the first passage and the second passage being aligned when the upper body is coupled to the lower body.

In an embodiment, a method includes providing an upper body. The method also includes determining one or more features of a tubing hanger for removal from a well. The method further includes selecting, from a set of lower bodies, a lower body based, at least in part, on the one or more features. The method also includes coupling, to the upper body, the lower body selected from the set of lower bodies.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1A:
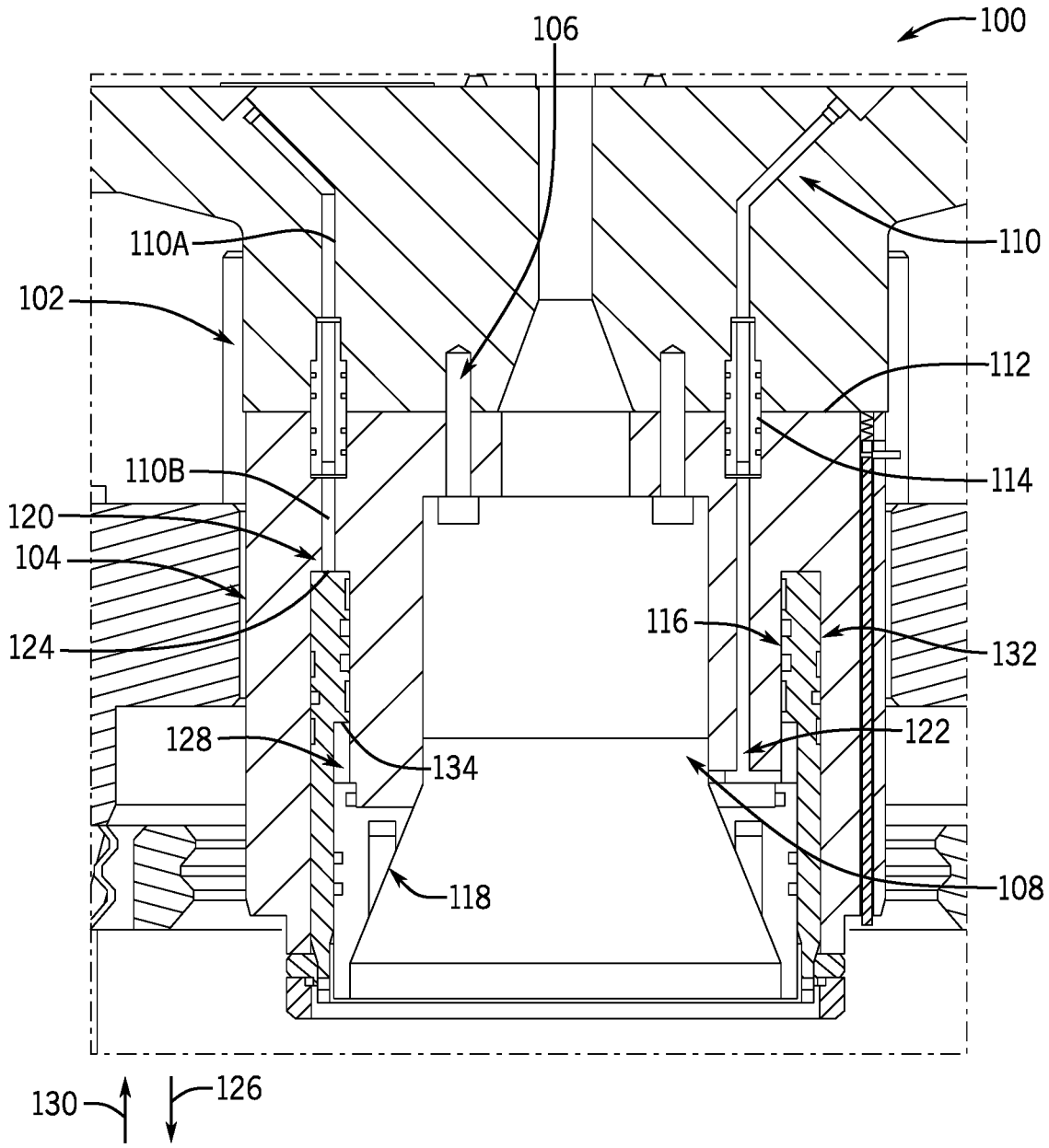
FIGS. 1A and 1B are cross-sectional views of an embodiment of a modular tool, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward one or more open water universal recovery tools (OWURT) that offer operators the ability to retrieve a tubing hanger and/or equipment of a similar nature/mechanism during regular or plug and abandon operations without the need for a rig to be installed over the well. In various embodiments, systems and methods provide a tool that allows operators to retrieve the equipment from a light well intervention (LWI) vessel, resulting in substantial savings in terms of both time and cost. Current systems and methods do not provide such an option and utilize larger workover components in order to remove components, such as hangers and various other equipment.

Various embodiments of the present disclosure are directed toward systems (e.g., tools, tool assemblies, etc.) and methods that can be run on a wireline from an LWI vessel and provide substantial forces on downhole components. These forces would normally be generated by pulling on a drill pipe from some type of rig or vessel, which may include, but is not limited to a mobile and offshore drilling unit (MODU), a floating production storage and offloading (FPSO) vessel, or the like. Embodiments provide a small and compact tool that is modular, easy to deploy, easy to operate, and easy to recover. As a result, tubing hangers (or other components) may be recovered "open water" using wireline and can be carried out from a boat or vessel, rather than a rig. Various embodiments enable wireline deployment and operation using one or more of umbilical lines from a vessel or via a remotely operated vehicle (ROV) interfacing. In at least one embodiment, systems and methods provide substantial unlock forces, which may meet or exceed forces applied by conventional tooling, such as tubing hanger secondary retrieving tools (THSRT), tubing hanger running tools (THRT), and tubing hanger emergency retrieval tools (THERT).

In at least one embodiment, systems and methods provide tools that can hydraulically unlock (e.g., up to 566 kips) and facilitate open water recovery of multiple pieces of equipment, such as conventional tubing hangers, horizontal internal tree caps (ITC)s, and horizontal tubing hangers, among other options. It should be appreciated that 566 kips is provided by way of non-limiting example only and is not intended to restrict the scope of the instant application, as various embodiments may apply more or less force. Various embodiments provide module components that provide for agnostic interchangeability to interface with a variety of different configurations, such as tubing hangers. Furthermore, embodiments provide for tools that can be run on wire from an LWI vessel or drill pipe from a MODU. Various embodiments further provide a tool complete with a latch piston visual indicator/mechanical overpull rods as an additional secondary recovery option.

Various embodiments of the present disclosure overcome various drawbacks present in existing techniques. By way of example, systems and methods are configurable for different hanger types and ITCs, which provides significant advantages over current tooling options. Furthermore, embodiments include a visual indicator/overpull rods to aid operational ease, which have not been added to the previous tools, which rely on volume control. This addition offers a secondary means of unlatch in the event that hydraulic communication with the tool is lost during operations. Additionally, the design of the internal components provides modular functionality and makes it far cheaper and easier to service, inspect, and convert. As noted, while various embodiments may describe hanger removal, systems and methods are not limited to such applications.

In at least one embodiment, systems and methods include a modular tool concept that includes an upper body and a lower body, where the different bodies are coupled together via one or more fasteners, among other options. As will be described below, the modular tool concept provides for improved configurations per tool equipment style (e.g., cylinders will not have to be removed) to reduce costs and maintenance. Additionally, various embodiments may provide common or universal interfaces that specific "kits" or other tools can mate to. In at least one embodiment, a length of the upper body may be modified. Furthermore, in at least one embodiment, one or more latch pistons and/or latch piston retaining rings may further provide for modular operations. For example, rather than positioning a latch piston within an inner body, the latch piston may be held in place by a retaining ring. Modular configurations are further provided by using internal and external rings to facilitate fastening components together.

Furthermore, in at least one embodiment, the modular tool concept may further include indicator/overpull rods. In at least one embodiment, the rods provide an improvement over previous systems that relied on volume pumped/returned in order to indicate position. In sharp contrast, the indicator/overpull rods may provide a visual indication that is easier to see.

In at least one embodiment, the indicator/overpull rods protrude up through the upper body and may be located proximate a sleeve indicator. In order to provide improved spacing, various embodiments may incorporate a low-tech indicator into the modular tool. Instead of going up through the flat surface of the upper body, the indicator may be fitted to the lower body only and be visible between the upper and outer bodies. However, in various embodiments, the indicator may protrude through the upper body. Moreover, various embodiments include a contingency measure, where in the event of loss of hydraulic function the rods (by means of shackle and sling arrangement or jacks) can be utilized to pull up the latch piston and facilitate recovery of the tool from the tubing hanger.

Various embodiments can be reconfigured to suit additional applications through changing out of one or more interface kits. The upper body, cylinders, outer body, ROV panel, flanged adapter, and smaller ancillary parts connected here would remain common. However, the kit for the additional application would implement a new lower body, latch piston, retaining ring (e.g., inner body), connector rods, and connector spacers. Furthermore, in at least one embodiment, latch dogs can be utilized from an existing THERT tool and incorporated into the kit.

Various embodiments can be reconfigured to suit an ITC application through changing out of one or more interface kits. The upper body, cylinders, outer body, ROV panel, flanged adapter, and smaller ancillary parts connected here would remain common. However, the ITC kit would implement a new lower body, connector rods, and connector spacers. Furthermore, in at least one embodiment, latch dogs can be utilized from an existing OWUPT tool and incorporated into the kit. The Latch Piston and Retaining Ring can be made compatible with both ITC and tubing hanger variants. It should be appreciated that an ITC may sit higher than a hanger, and as a result, height adjustments may be implemented.

Figure 1B:
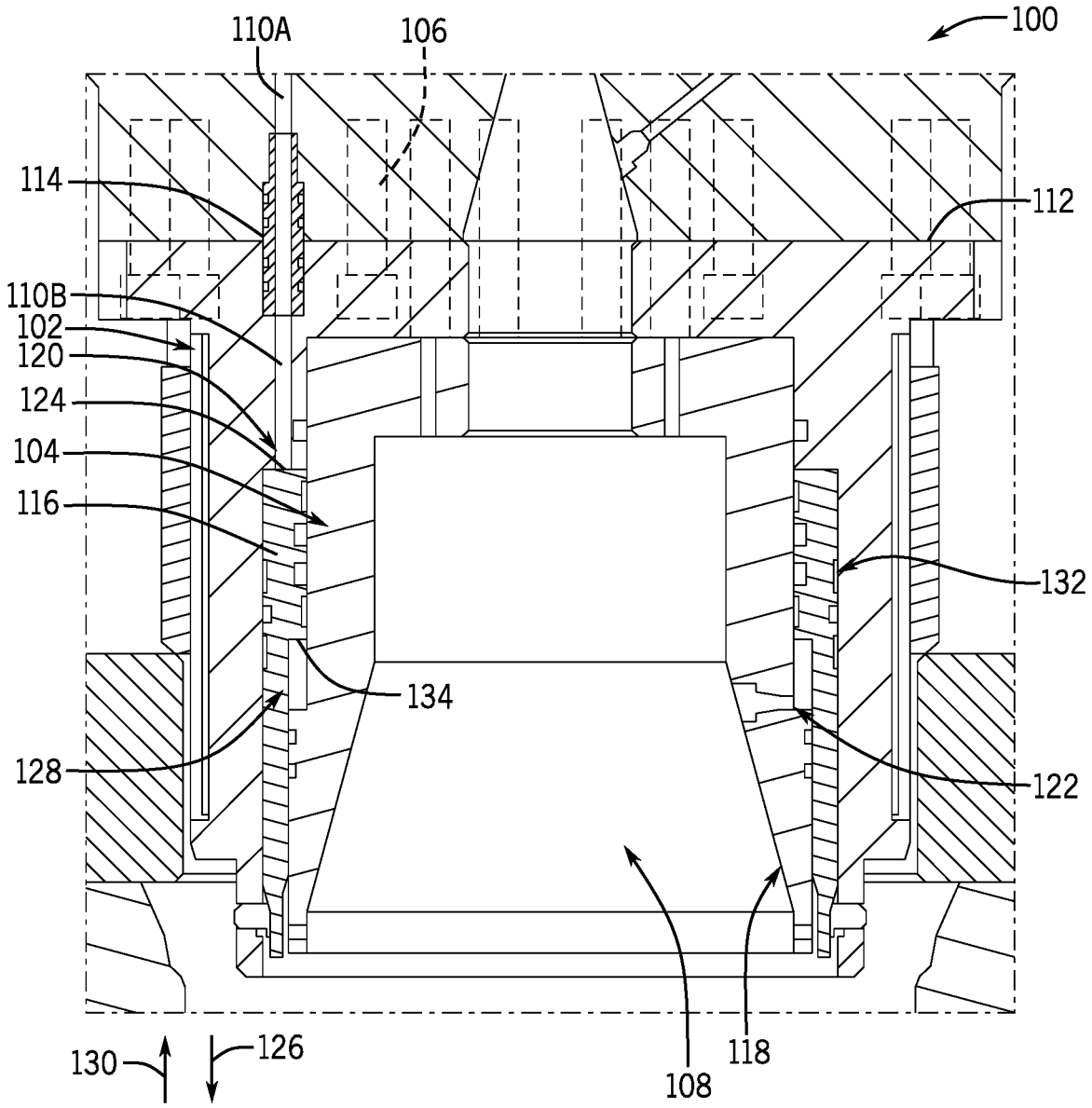

FIGS. 1A and 1B are cross-sectional views of an embodiment of a modular tool 100, which may also be referred to as an Open Water Universal Recovery Tool (OWURT). It should be appreciated that various components have been removed for clarity with the present discussion. In this example, one or more components of the modular tool 100 may form a portion of a kit, where the kit may include one or more components specific for operation with a certain end connector and, when different end connectors are used, a different kit may be utilized. However, one or more portions of the modular tool may be reused with each type of kit.

In this example, an upper body 102 is coupled to a lower body 104. The upper body 102 may be joined to the lower body 104 via one or more fasteners 106 to facilitate both connection and disconnection of the upper body 102 to the lower body 104. As will be described herein, in various embodiments, the fasteners 106 may be positioned at a variety of locations to permit coupling the upper body 102 to the lower body 104. In at least one embodiment, the lower body 104 is secured to the upper body 102 via an internal ring and an external ring of fasteners, such as cap screws. However, it should be appreciated that a variety of different fasteners and connection devices may be utilized within the scope of the present disclosure. In various embodiments, different connectors may be selected based, at least in part, on expected operating conditions because the connection between the components may be exposed to an expected or anticipated pressure. Various embodiments may utilize kits where the lower body 104 is removed and replaced with a different lower body having different dimensions (e.g., a second lower body). Accordingly, in at least one embodiment, the fasteners 106 may be accessible from an interior portion, such as a bore 108. In various embodiments, the bore may be formed in the lower body. In certain embodiments, the bore may be referred to as an inner body bore. Moreover, in embodiments, additional fasteners may be accessible from an exterior portion. Additionally, in at least one embodiment, addition connection devices such as clips, dogs, bayonet fittings, and the like may be utilized.

As shown, various passages 110 are provided through the upper body 102 that couple to associated passages 110 in the lower body at an interface 112. For example, the passages 110A associated with the upper body 102 may be referred to as upper passages while the passages 110 associated with the lower body 104 may be referred to as lower passages. 110B. In at least one embodiment, one or more seals or sleeves 114 extends across the interface 112 to reduce a likelihood of leaks at the interface 112. It should be appreciated that a location of the passages 110 may be maintained between different modular components such that swapping out the lower body 104 will not interfere with operation of the tool 100. That is, even if a different lower body 104 configuration is utilized, a location of the passages 110 may be similar across all different lower body configurations so that rework or other modifications are not necessary. In this manner, the tool 100 may be modular and/or part of a kit that allows for rapid replacement of various components while also reusing different portions, thereby reducing costs for users.

Further illustrated within the lower body 104 is a latch piston 116 and a latch piston retaining ring 118, which may also be referred to as an inner body. The latch piston retaining ring 118 may maintain a position of the latch piston 116 within the lower body 104. In various embodiments, the latch piston 116 is coupled to the lower body 104. Moreover, in embodiments, the latch piston retaining ring 118 may include one or more surfaces to block or restrict movement of the latch piston 116 beyond a predetermined location. The latch piston retaining ring 118 may replace one or more features, such as components of the lower body 104, to retain the latch piston 116. As a result, different adjustments to the latch piston 116 may be made to interact with particular components. Such adjustment may be associated with changes to the lower body 104 as well, but would not affect the upper body 102, as these components are modular and configured to be swapped out for intended uses. In at least one embodiment, the latch piston retaining ring 118 is an annular component. In at least one embodiment, the latch piston retaining ring 118 is a segmented component.

In this example, the latch piston 116 is shown associated with a latch port 120 and an unlatch port 122. As shown, the latch port 120 is fluidly coupled to the passage 110A (e.g., the lower passage 110A) that receives a fluid, such as a hydraulic fluid, from the passage 110B (e.g., the upper passage 110B). In at least one embodiment, the latch port 120 directs fluid (and the associated fluid pressure) to a top 124 of the latch piston 116, driving the latch piston 116 in an axially downward direction 126. In at least one embodiment, the axially downward direction 126 may refer to a downhole direction and/or to a direction away from the upper body 102. For example, upon activation, the fluid is directed through the passages 110 to drive the latch piston 116 in the downward direction 126, which thereby causes a gap 128 between the latch piston 116 and the latch piston retaining ring 118 to reduce (e.g., a length of the gap is reduced) as the latch piston 116 moves in a downward direction to facilitate removal and recovery of one or more components.

In contrast, the unlatch port 122 removes fluid pressure acting at the bottom 134 of the latch piston 116. For example, in at least one embodiment, the unlatch port 122 is similarly coupled to flow passages 110 and to the gap 128. Upon activation, fluid may flow through the flow passages 110 and into the gap 128, thereby driving the latch piston 116 in an upward direction 130 (e.g., opposite the downward direction 126, in an uphole direction, toward the upper body 102). As a result, the length of the gap 128 is increased and the piston latch piston 116 is retracted. In this manner, different flow activation may be utilized to latch and unlatch the piston 116.

Various embodiments of the present disclosure position the latch piston 116 within a space 132 that permits axial movement of the latch piston 116 responsive to a location of fluid pressure activation. For example, movement through the space 132 in the downward direction 126 may be responsive to fluid pressure at the top 124 and movement through the space 132 in the upward direction 130 may be responsive to fluid pressure at a bottom 134. The latch piston 116 may include seals to block fluid from moving from the top 124 to the bottom 134, and as a result, control of fluid flow through the passages 110 may be used to activate and deactivate the latch piston 116.

FIGS. 2A-2D are cross-sectional views of an embodiment of the tool 100 illustrating overpull/indicator rods 200 (e.g., rods). In at least one embodiments, the rods 200 act to provide visual indication of the latch piston 116 position. Moreover, the rods 200 may function as a contingency measure in the event of loss of hydraulic function, the rods, by means of shackle and sling arrangements or jacks, may be utilized to pull up the latch piston 116 and facilitate recovery of the tool 100 from the tubing hanger and/or similar equipment.

In this example, the rods 200 include a rod top 202 including an eye, a rod guide bushing 204, a rod shaft 206, and a rod seal bushing 208. As shown, the rod shaft 206 extends across the interface 112. It should be appreciated that the rods 200, and their associated components, may be arranged on differing angles than the sleeves 114. For example, in at least one embodiment, the rods 200 may be offset by approximately 90 degrees from the sleeves 114. It should be appreciated that such an offset is provided by way of example only and may be different in various embodiments.

The rod shafts 206 may be coupled to the latch piston 116, for example via one or more fasteners. In operation, hydraulic pressure may be utilized to drive movement of the rods 200, thereby driving movement of the latch piston 116.

Figure 2A:
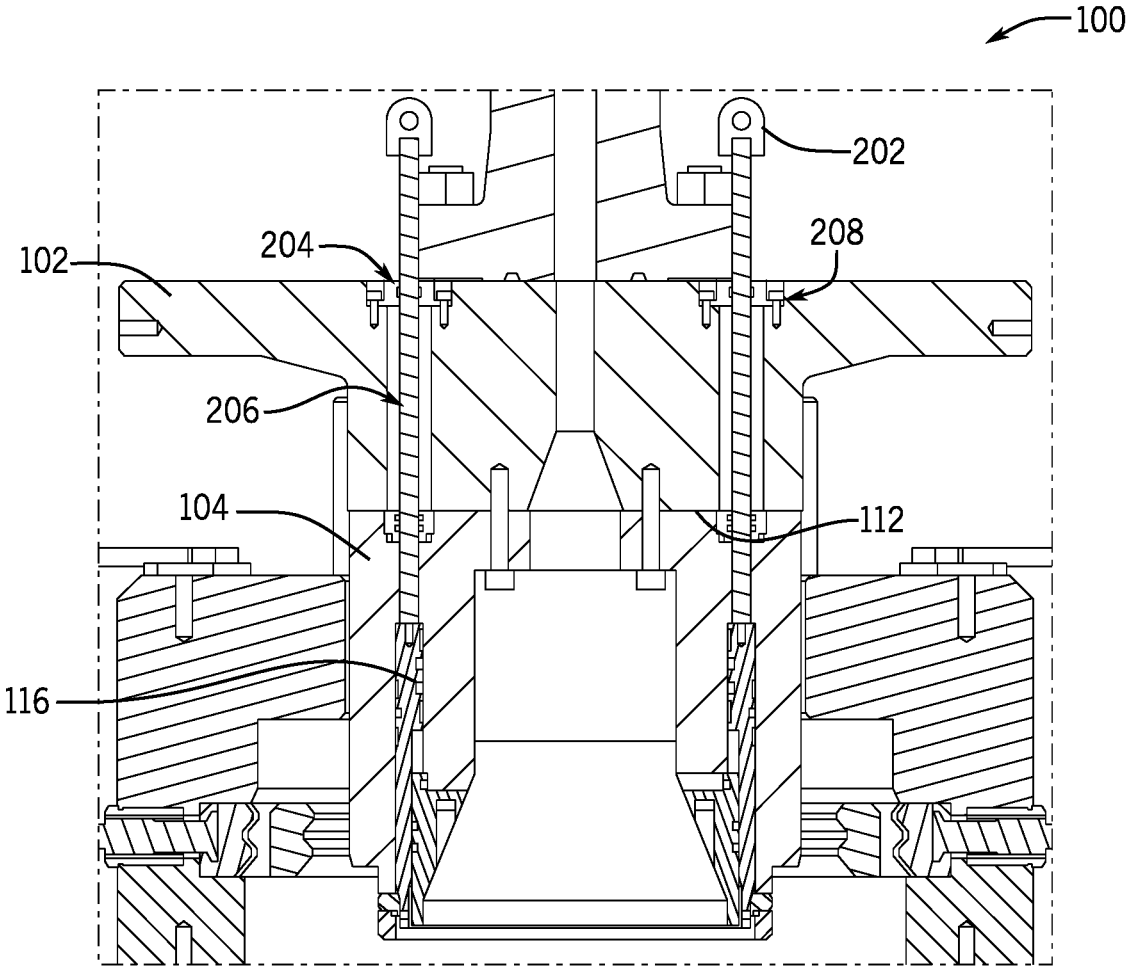
FIGS. 2A-2D are cross-sectional views of embodiments of a modular tool, in accordance with embodiments of the present disclosure.
Figure 2B:
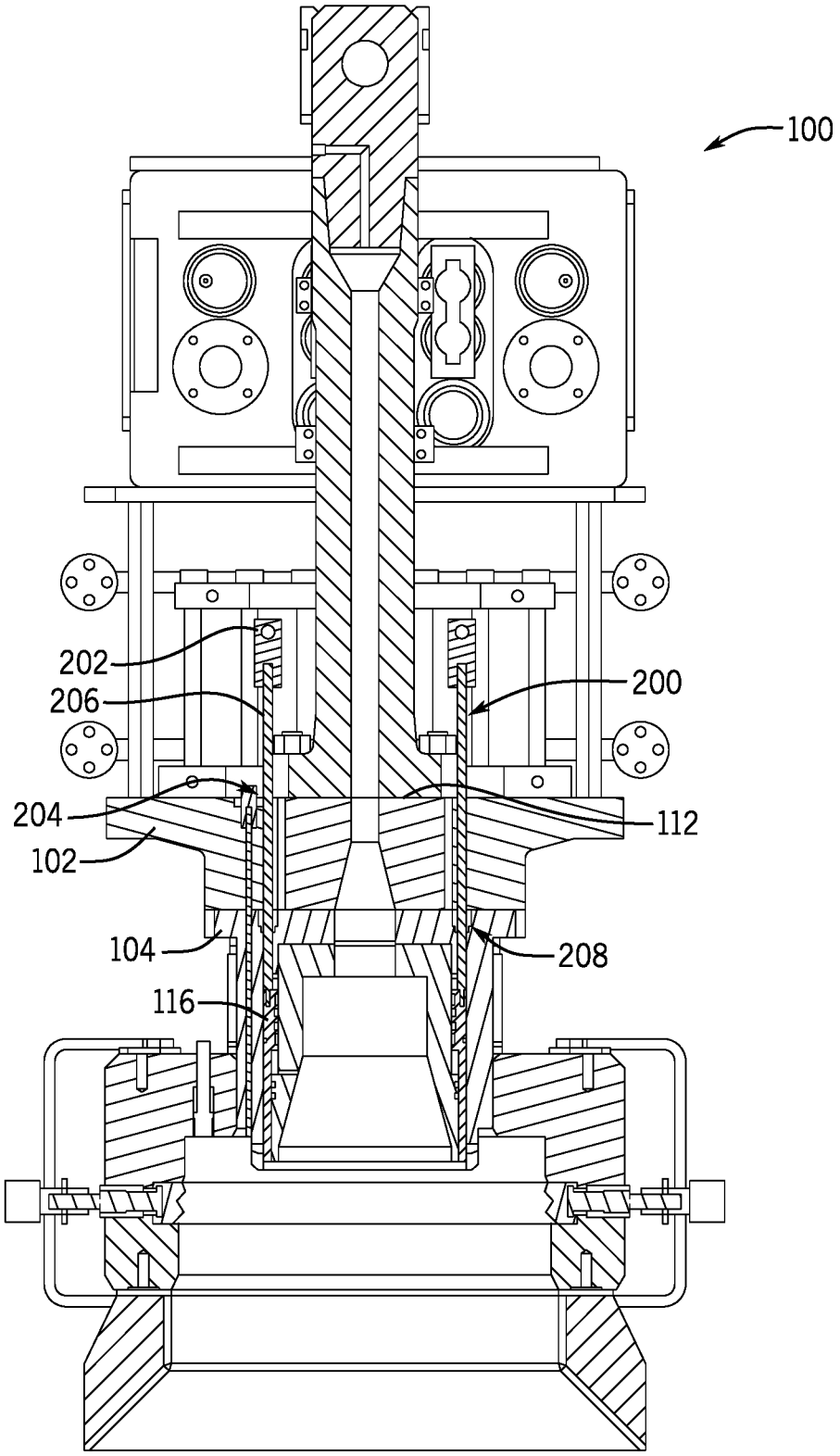
Figure 2C:
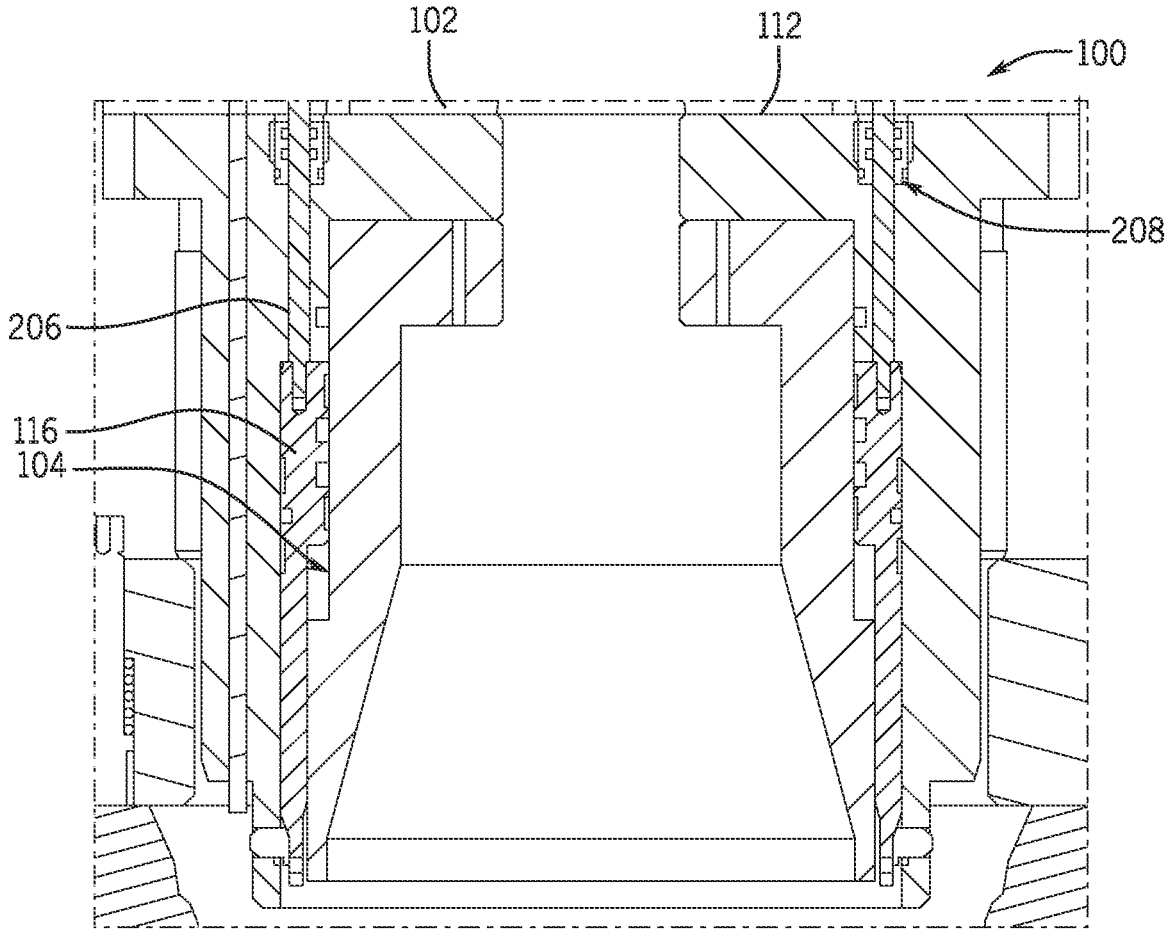
Figure 2D:
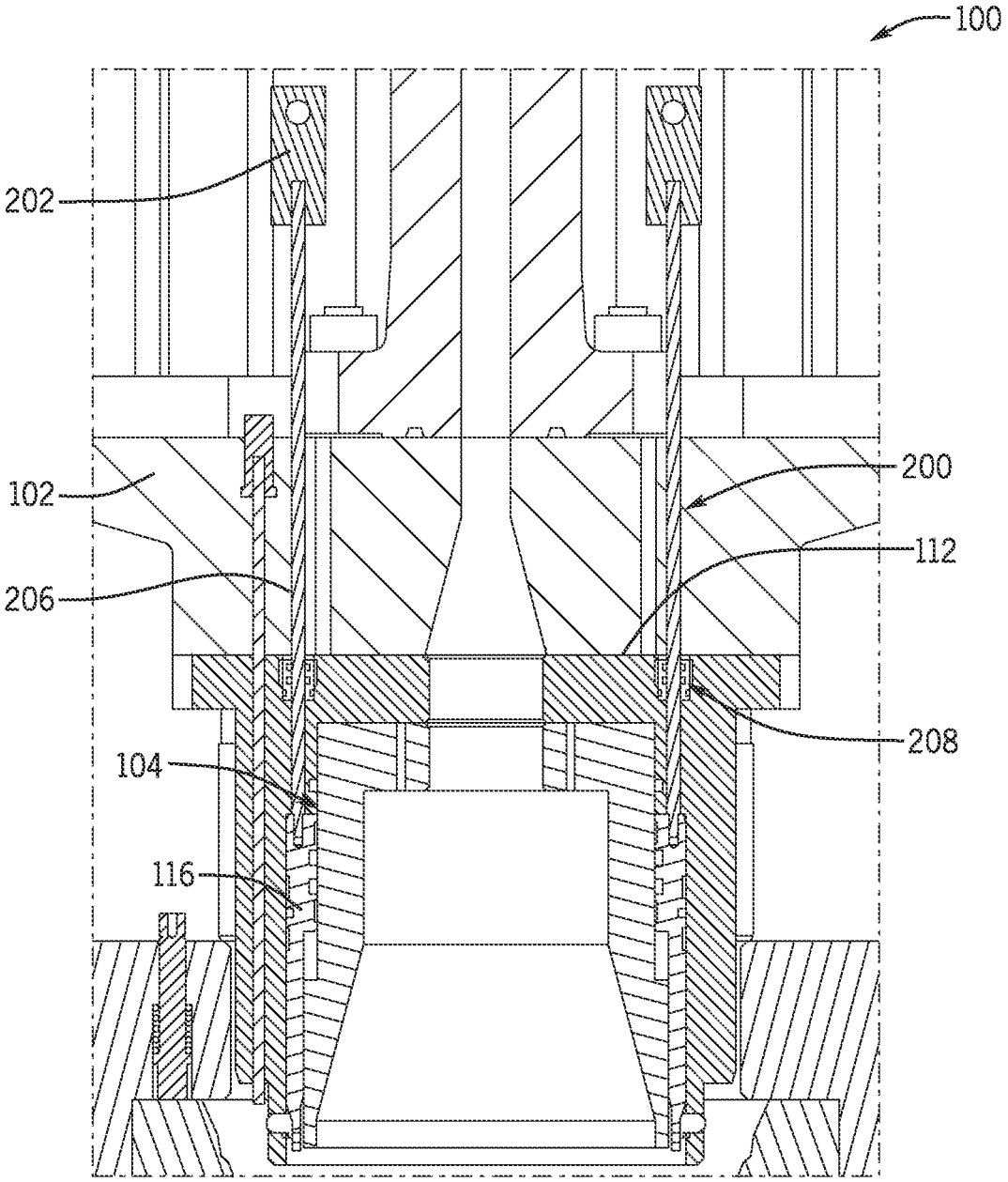

FIGS. 2B-2D are cross-sectional views of the tool 100 including the rods 200 in which the fasteners 106 are recessed within the lower body 104 such that the fasteners 106 are still accessible from the bore 108. For example, when comparing FIG. 2A to FIGS. 2B-2D, it can be seen the tops of the fasteners 106 (shown as cap screws) are not visible in FIGS. 2B-2D compared to FIG. 2A. Such a configuration may be provided by having a countersunk aperture that permits the tops of the fasteners 106 to be retracted into the lower body 104. In at least one embodiment, the functionality of the fasteners 106 may be retained and utilized in a similar manner between the configurations of FIGS. 2A-2D.

Figure 3:
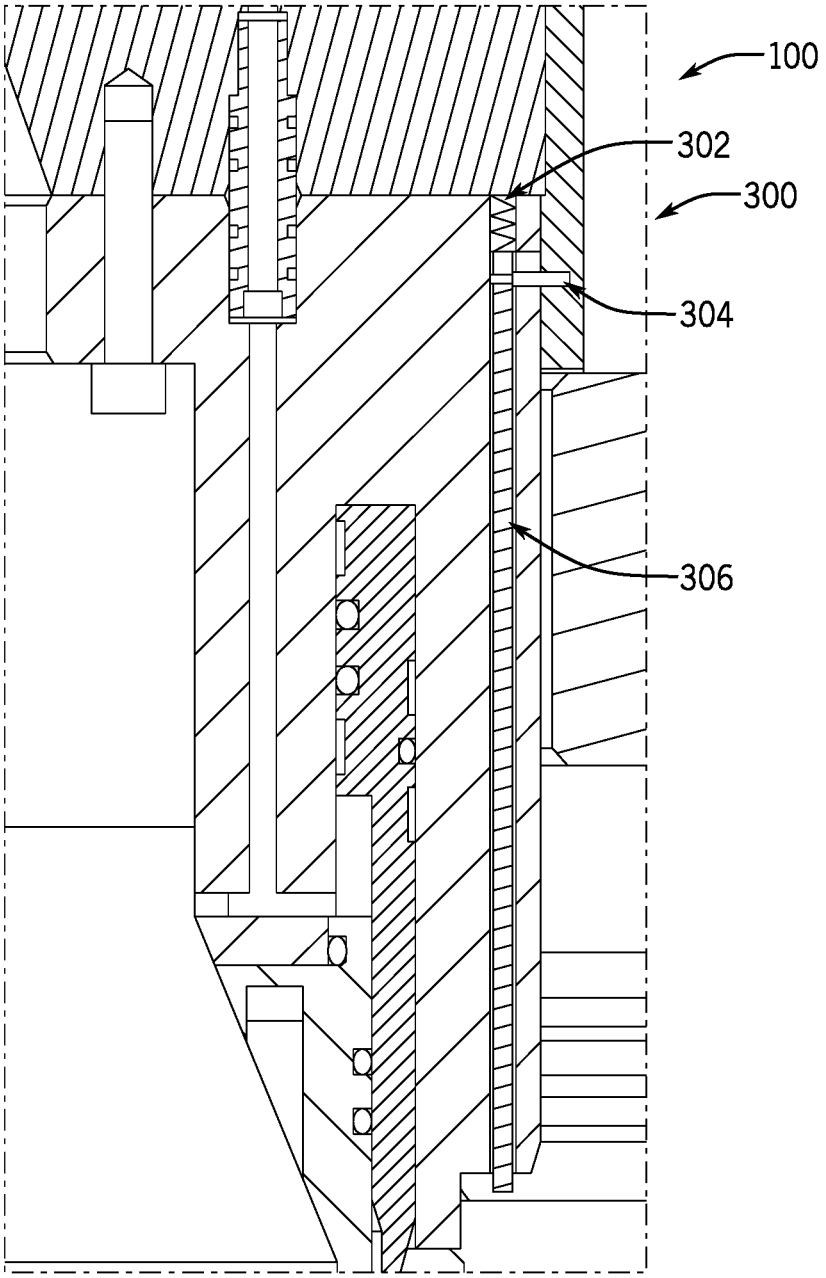
FIG. 3 is a cross-sectional view of an embodiment of an indicator for a modular tool, in accordance with embodiments of the present disclosure.
Figure 4A:
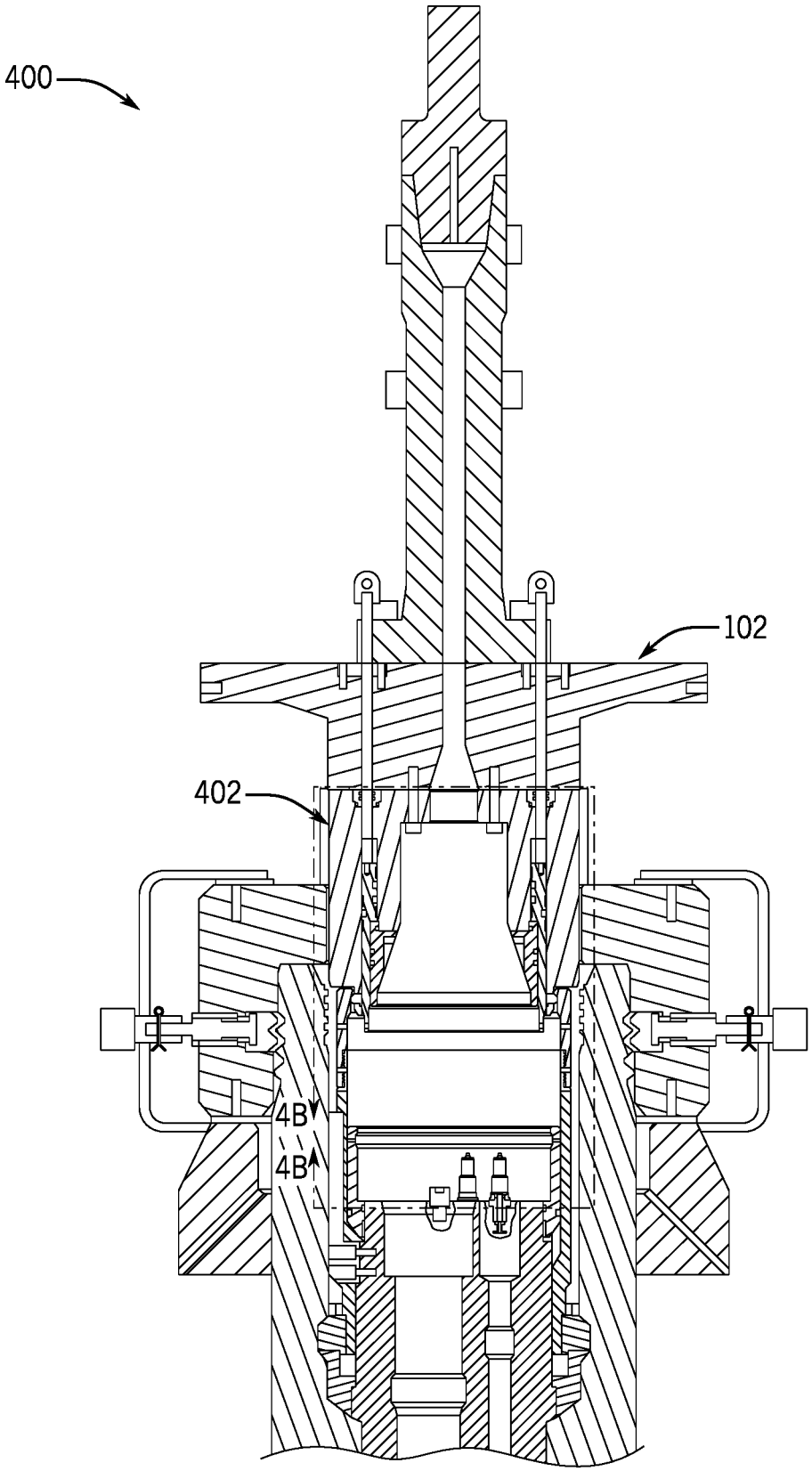
FIGS. 4A-4D are cross-sectional views of an embodiment of a modular tool, in accordance with embodiments of the present disclosure.
Figure 4B:
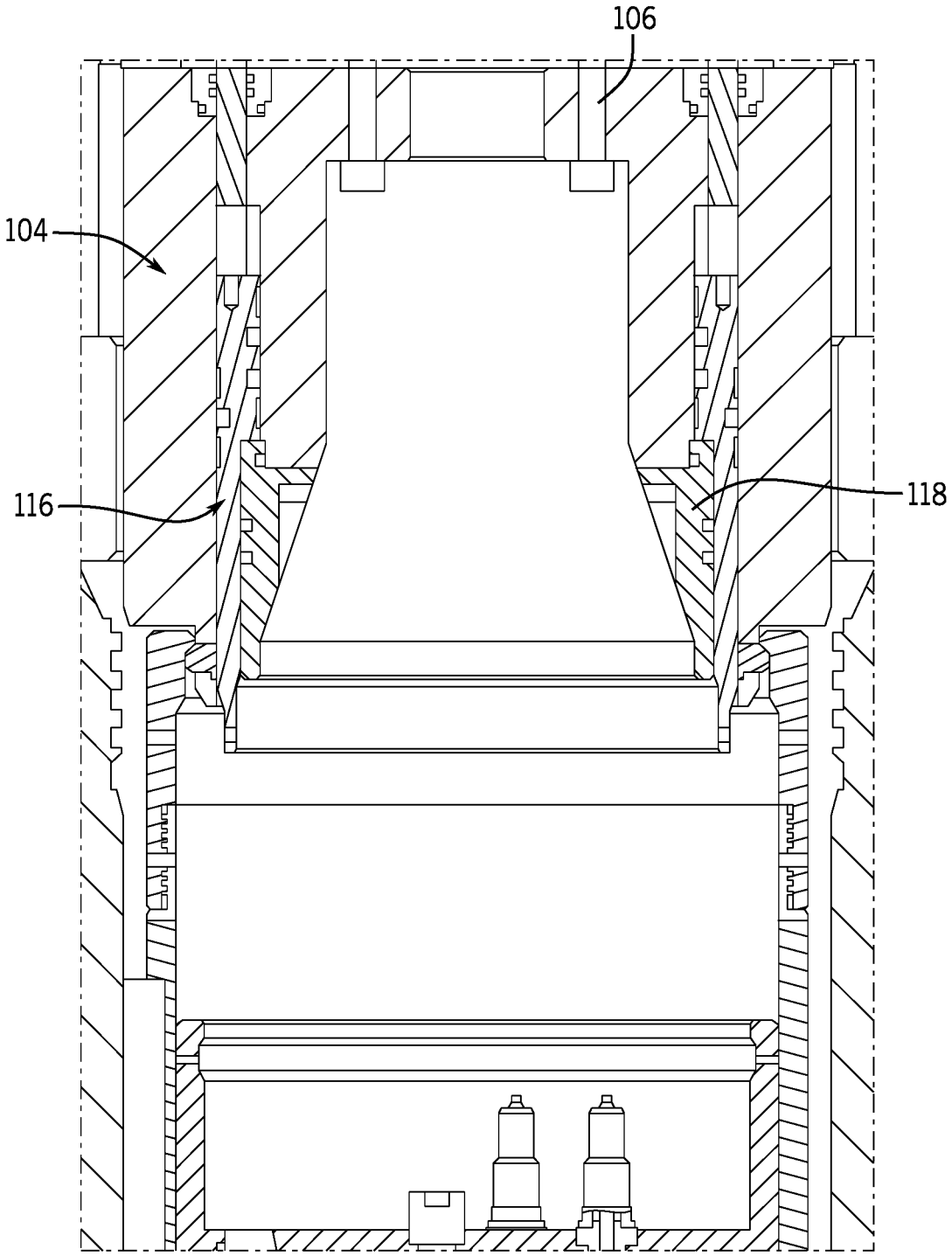
Figure 4C:
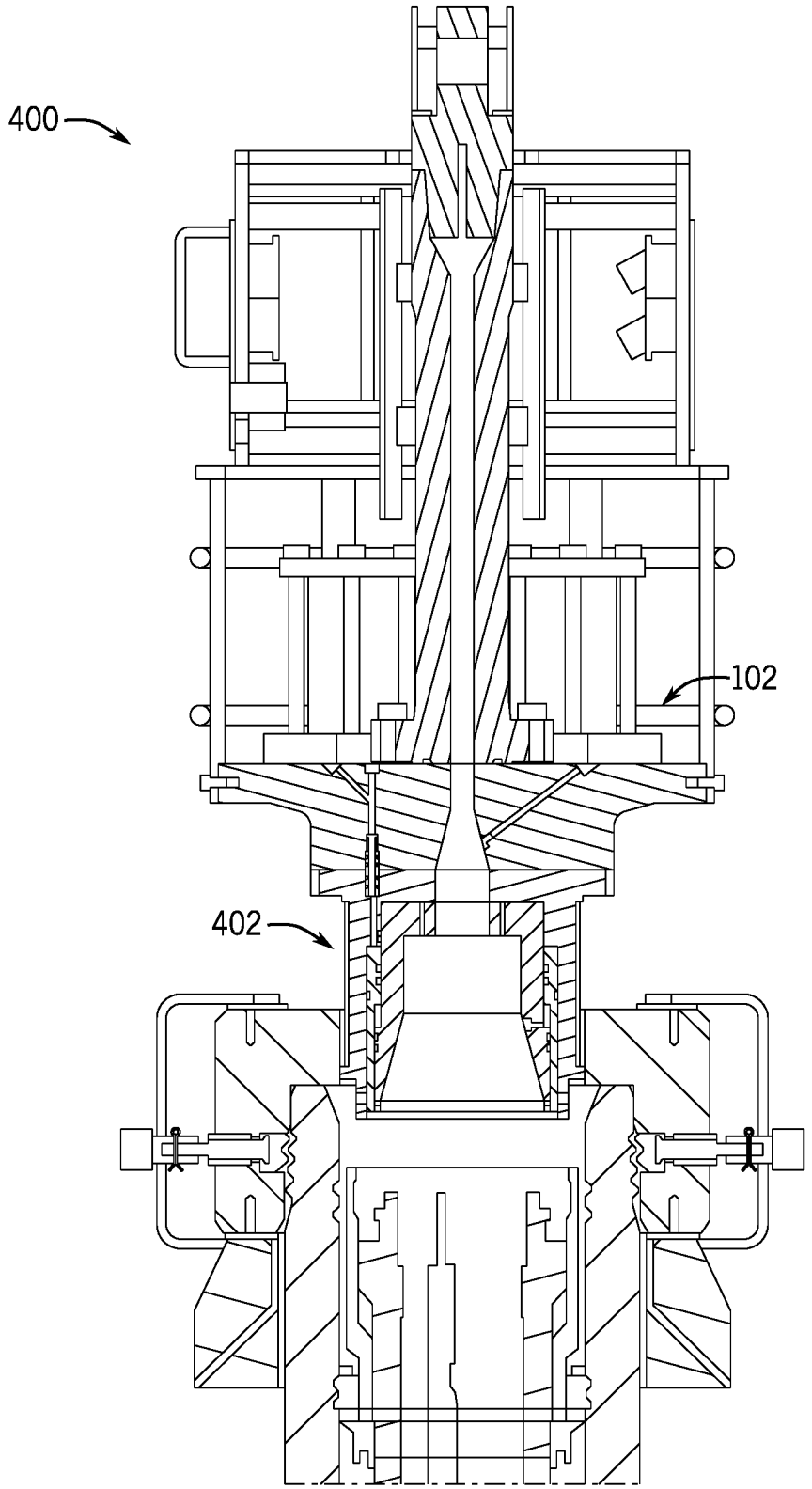
Figure 4D:
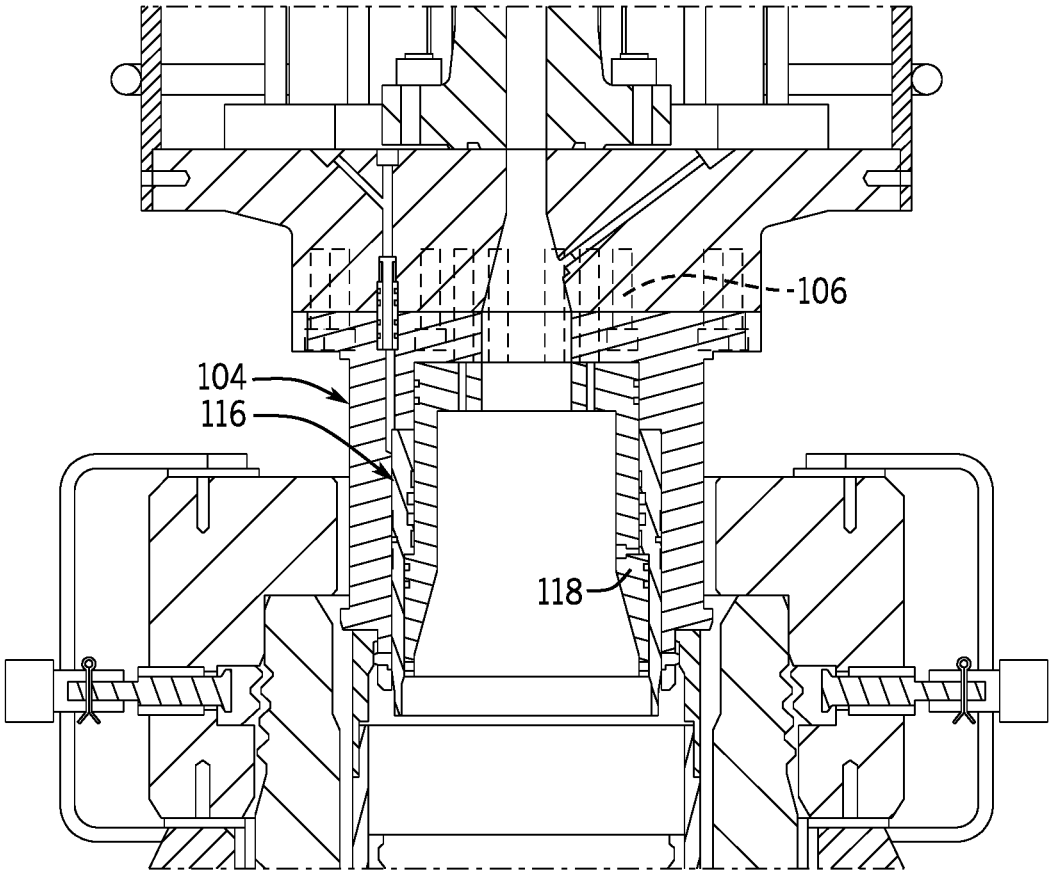

FIG. 3 is a cross-sectional view of the tool 100 including an indicator 300. The illustrated indicator 300 is incorporated into the lower body 104 and the upper body 102. The illustrated indicator 300 includes a spring 302, an indicator pin 304, and an indicator rod 306. In various embodiments, the indicator may be fit to go up through the flat surface of the upper body 102. In at least one embodiment, the indicator 300 is fit to the lower body 102 and visible between the upper and outer bodies.

FIGS. 4A-4D illustrate a kit 400 that may incorporate one or more features of the above-described tool. In this example, the kit 400 may be particularly selected for one or more applications. As shown, an interface kit 402 may form a portion of the kit 400, where the interface kit 402 includes various components associated with the lower body 104. In various embodiments, components of the kit 400 may be reused with different configurations, such as various components associated with the upper body 102. However, in this example, specific components such as the lower body 104, the latch piston 116, the latch piston retaining ring 118, and the like may be particularly selected and formed based, at least in part, on features of the particular application. Due to the modular nature of the configuration, it may be quick to swap out the lower body 104 and its associated components, for example by removing the fasteners 106 to replace the chosen lower body 104 and associated components.

Figure 5A:
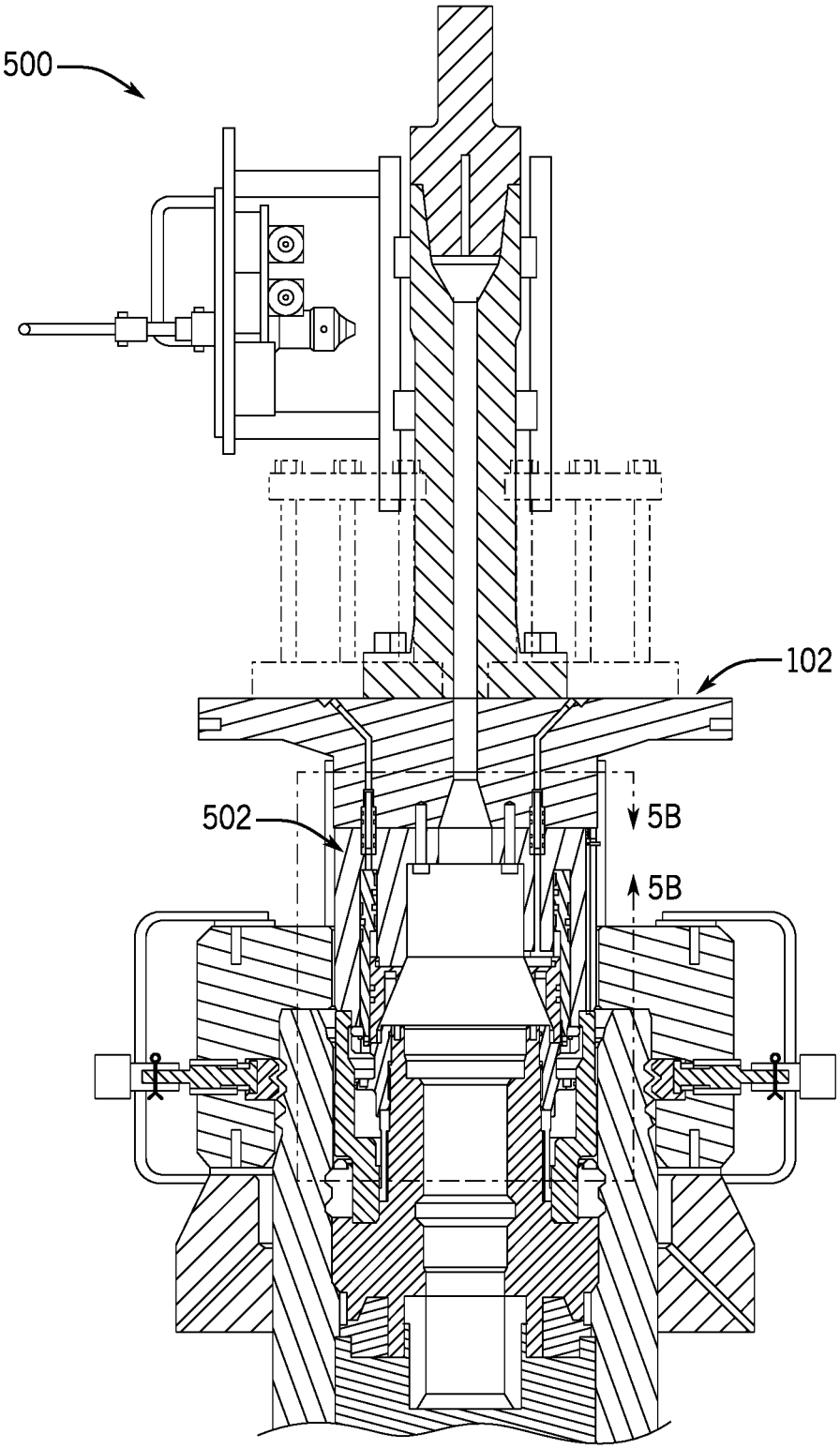
FIGS. 5A-5C are cross-sectional views of an embodiment of a modular tool, in accordance with embodiments of the present disclosure.
Figure 5B:
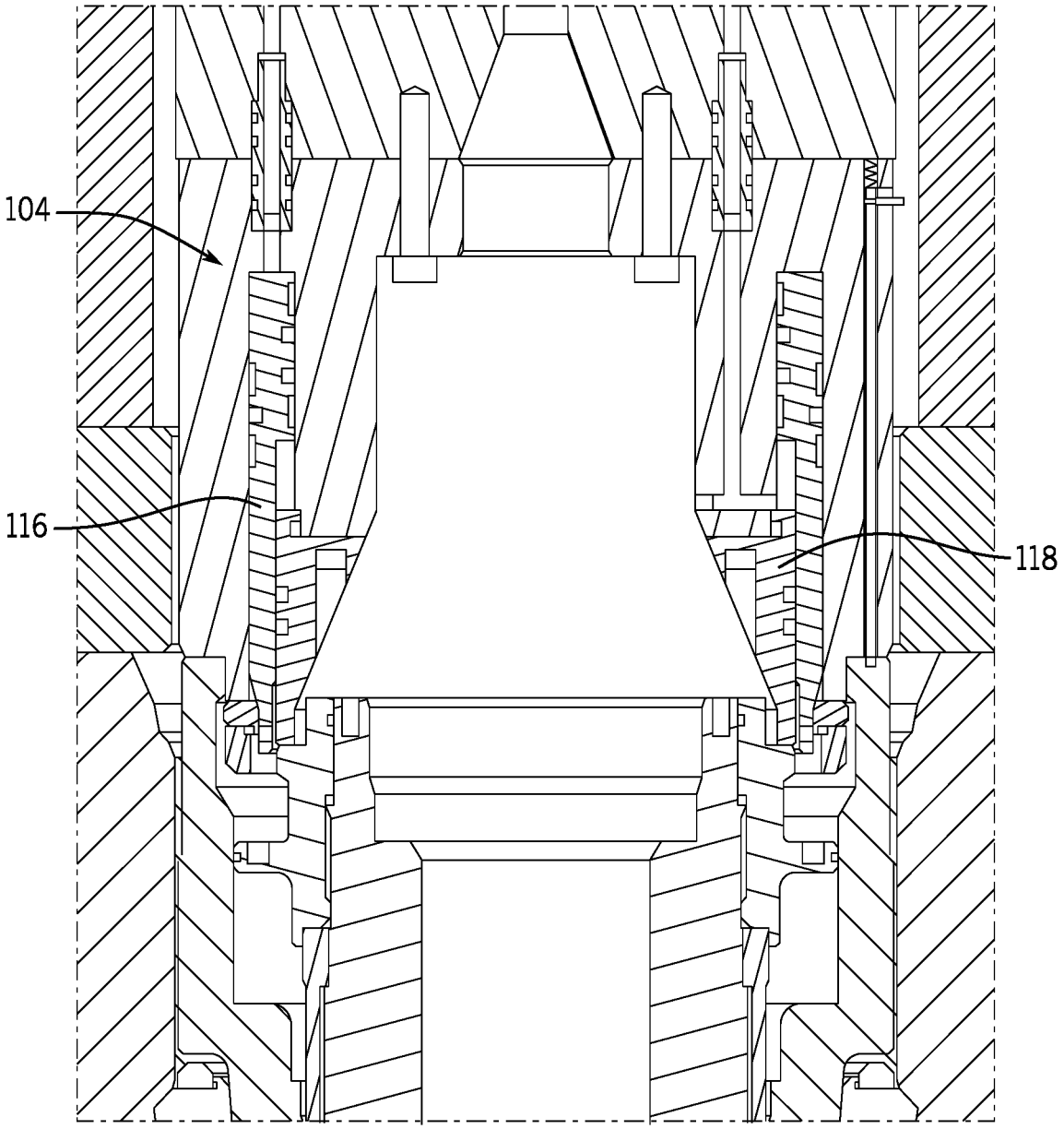
Figure 5C:
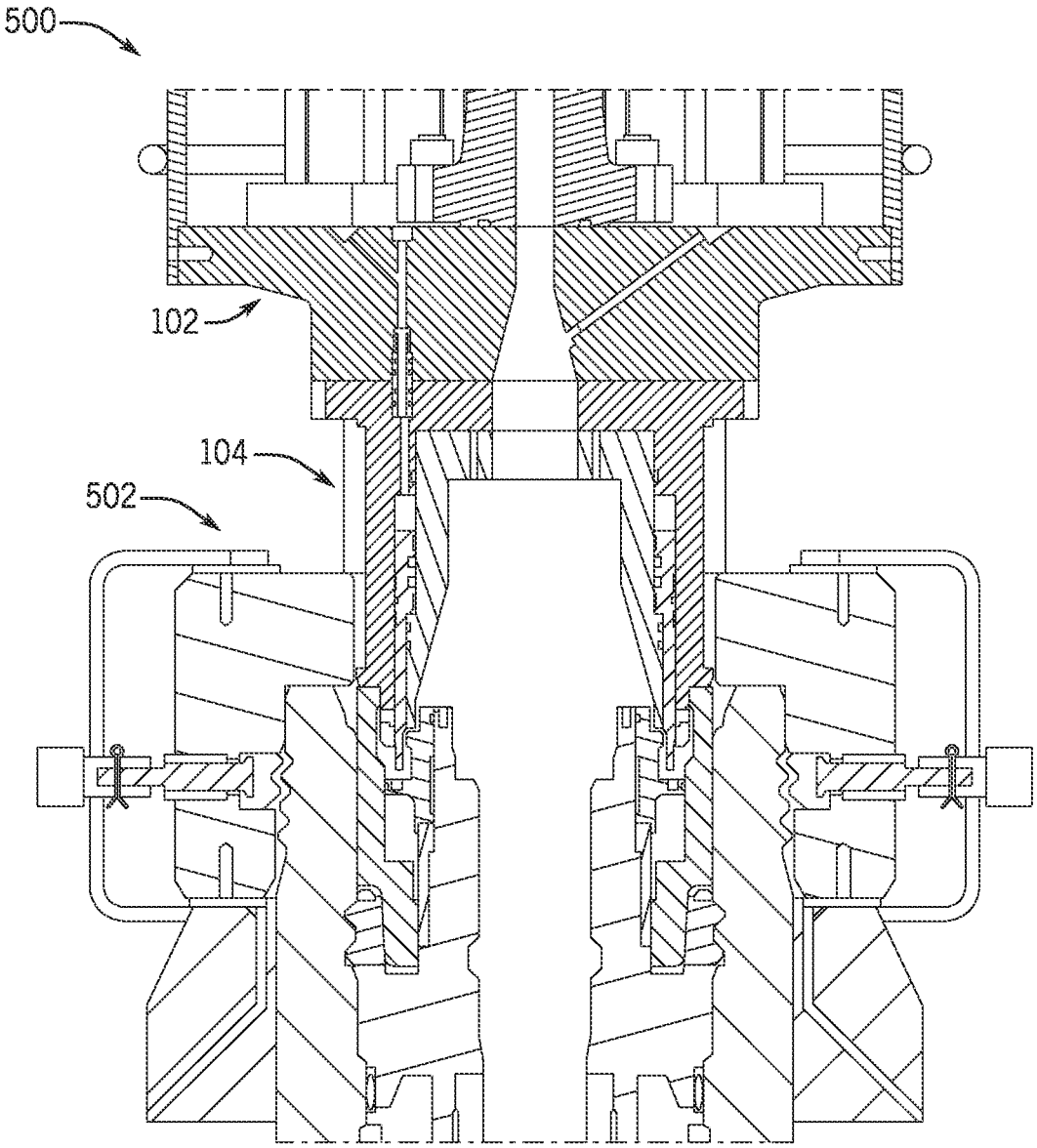

FIGS. 5A-5C illustrate a kit 500 for that may incorporate one or more features of the above-described tool. In this example, the kit 500 may be particularly selected for an ITC application. As shown, an interface kit 502 may form a portion of the kit 500, where the interface kit 502 includes various components associated with the lower body 104. In various embodiments, components of the kit 500 may be reused with different configurations, such as various components associated with the upper body 102. However, in this example, specific components such as the lower body 104, the latch piston 116, the latch piston retaining ring 118, and the like may be particularly selected and formed based, at least in part, on features of the ITC application. Due to the modular nature of the configuration, it may be quick to swap out the lower body 104 and its associated components, for example by removing the fasteners 106 to replace the chosen lower body 104 and associated components.

Figure 6:
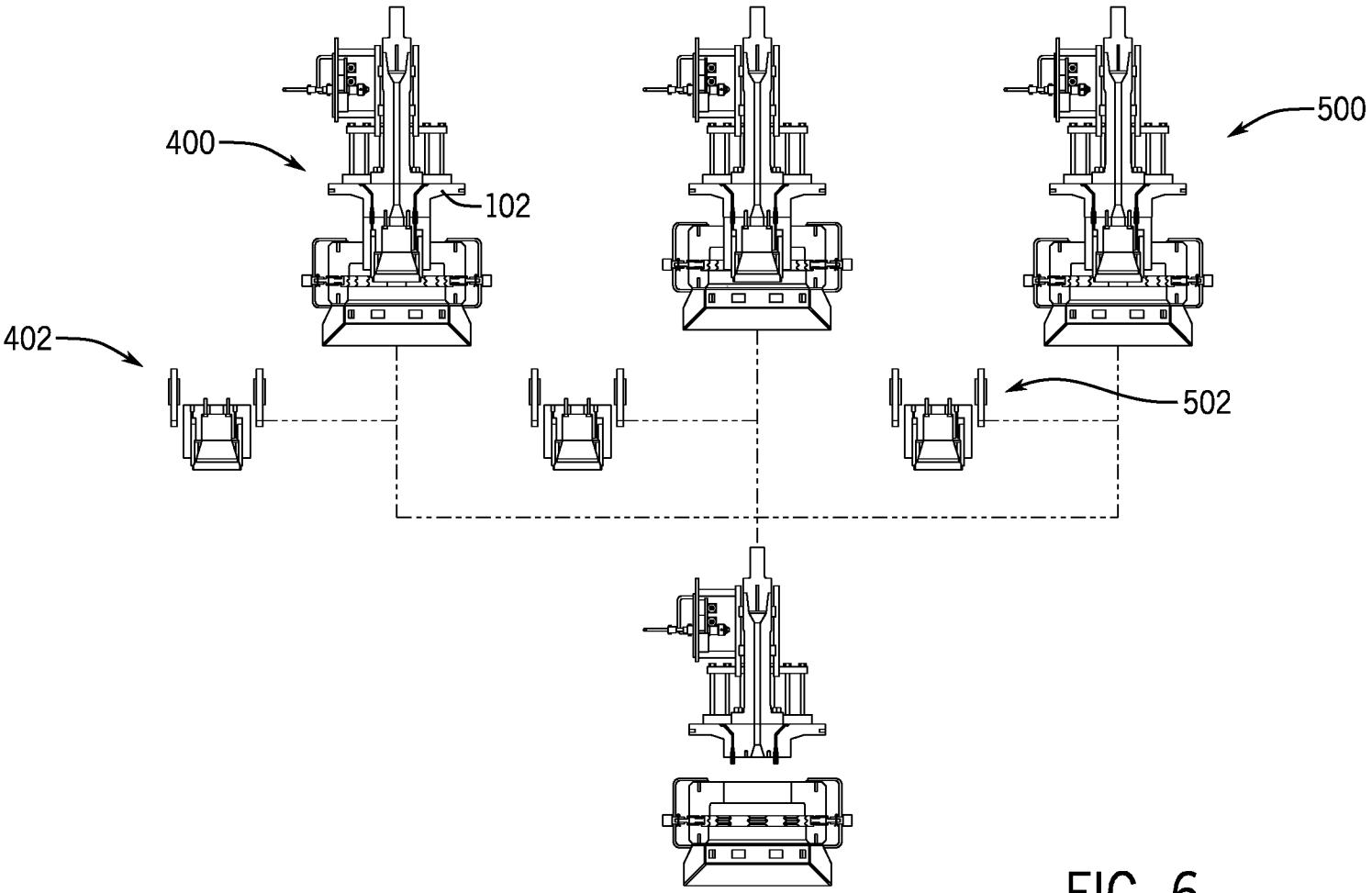
FIG. 6 is a schematic view of an embodiment of modular tool kits, in accordance with embodiments of the present disclosure.

FIG. 6 illustrates modification and removal of various components of the tool 100 to form a modular tool where one or more components may be selected and swapped in favor of one or more additional components based, at least in part, on a desired application. In this example, the kit 400 is shown sharing one or more features with the kit 500, such as the upper body 102. However, as shown, the respective interface kits 402, 502 may be swapped in order to generate a different assembly for use with different types of mating surfaces. It should be appreciated that ITCs, hangers, and the like are shown as examples only and that additional configurations may also be utilized within the scope of the present disclosure. By providing components that can be rapidly swapped out and replaced, various embodiments may provide for a tool that provides greater flexibility in the field.

Figure 7:
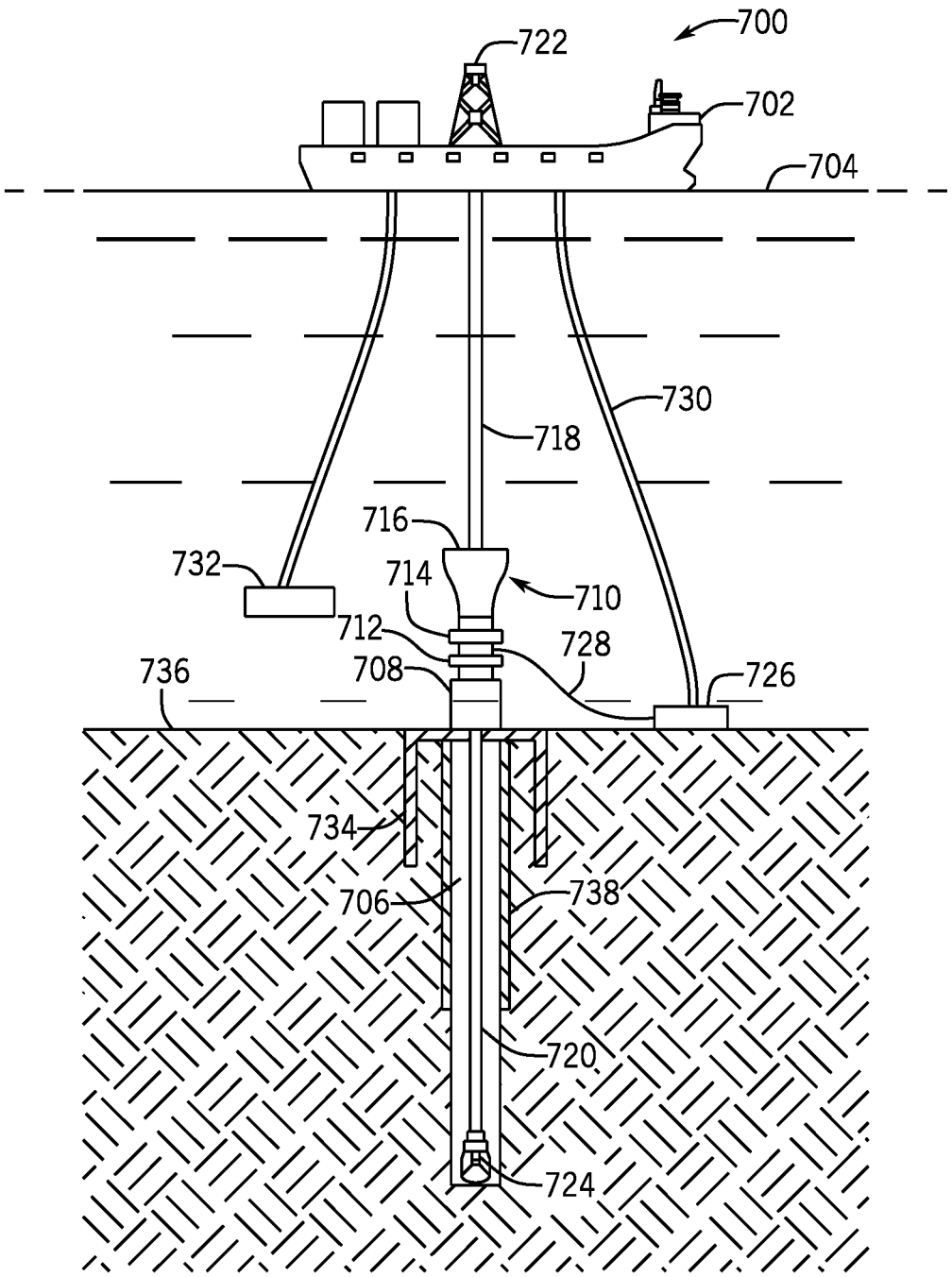
FIG. 7 is a schematic side view of an embodiment of an offshore drilling operation, in accordance with embodiments of the present disclosure.

FIG. 7 is a side schematic view of an embodiment of a subsea drilling operation 700. It should be appreciated that one or more features have been removed for clarity with the present discussion and that removal or inclusion of certain features is not intended to be limiting, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. The drilling operation includes a vessel 702 floating on a sea surface 704 substantially above a wellbore 706. As noted, the vessel 702 is for illustrative purposes only and systems and methods may further be illustrated with other structures, such as floating/fixed platforms, and the like. A wellbore housing 708 sits at the top of the wellbore 706 and is connected to a blowout preventer (BOP) assembly 710, which may include shear rams 712, sealing rams 714, and/or an annular ram 716. One purpose of the BOP assembly 710 is to help control pressure in the wellbore 706. The BOP assembly 710 is connected to the vessel 702 by a riser 718. During drilling operations, a drill string 720 passes from a rig 722 on the vessel 702, through the riser 718, through the BOP assembly 710, through the wellhead housing 708, and into the wellbore 706. It should be appreciated that reference to the vessel 702 is for illustrative purposes only and that the vessel may be replaced with a floating/fixed platform or other structure. The lower end of the drill string 720 is attached to a drill bit 724 that extends the wellbore 706 as the drill string 720 turns. Additional features shown in FIG. 7 include a mud pump 726 with mud lines 728 connecting the mud pump 726 to the BOP assembly 710, and a mud return line 730 connecting the mud pump 726 to the vessel 702. A remotely operated vehicle (ROV) 732 can be used to make adjustments to, repair, or replace equipment as necessary. Although a BOP assembly 710 is shown in the figures, the wellhead housing 704 could be attached to other well equipment as well, including, for example, a tree, a spool, a manifold, or another valve or completion assembly.

One efficient way to start drilling a wellbore 706 is through use of a suction pile 734. Such a procedure is accomplished by attaching the wellhead housing 708 to the top of the suction pile 734 and lowering the suction pile 734 to a sea floor 736. As interior chambers in the suction pile 734 are evacuated, the suction pile 734 is driven into the sea floor 736, as shown in FIG. 7, until the suction pile 734 is substantially submerged in the sea floor 736 and the wellhead housing 708 is positioned at the sea floor 736 so that further drilling can commence. As the wellbore 706 is drilled, the walls of the wellbore are reinforced with concrete casings 738 that provide stability to the wellbore 706 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession. As noted above, configurations with respect to a sea floor or any offshore application are for illustrative purposes and embodiments of the present disclosure may also be utilized in surface drilling applications.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A wellbore system, comprising:

an upper body;

a lower body, removably coupled to the upper body;

a passage extending through both the upper body and the lower body, the passage being aligned and extending through an interface between the upper body and the lower body;

a second lower body, different from the lower body, the second lower body being removably coupled to the upper body via one or more fasteners, the second lower body having a passage portion configured to align with a portion of the passage extending through the upper body;

a latch piston, confined to the lower body, the latch piston being moveable responsive to an applied pressure via the passage, the latch piston moving relative to both the upper body and the lower body; and a latch piston retaining ring, confined to the lower body.

2. The wellbore system of claim 1, wherein one or more features of the lower body, the latch piston, or the latch piston retaining ring are particularly selected based, at least in part, on one or more components positioned to be engaged by the latch piston.

3. The wellbore system of claim 1, further comprising:

a rod extending through at least a portion of the upper body and the lower body, the rod being coupled to the latch piston.

4. The wellbore system of claim 3, wherein the rod is an indicator that moves responsive to a position of the latch piston.

5. The wellbore system of claim 3, wherein the rod is at a circumferentially offset position compared to the passage.

6. The wellbore system of claim 1, wherein the latch piston is positioned within a space formed in the lower body, and the passage further comprises:

a first passage portion fluidly coupled to a latch port of the space, the latch port proximate a top of the latch piston; and a second passage portion fluidly coupled to an unlatch port of the space;

wherein fluid pressure directed through the latch port to the top of the latch piston drives the latch piston in a downward direction and fluid pressure directed through the unlatch port to a bottom of the latch piston drives the latch piston in an upward direction.

7. The wellbore system of claim 1, further comprising:

a sleeve extending across the interface, the sleeve fluidly sealing flow through the passage between the upper body and the lower body.

8. The wellbore system of claim 1, further comprising:

an indicator positioned within one or both of the upper body or the lower body, wherein the indicator provides a visual indicator regarding make up of the lower body.

9. A wellbore tool kit, comprising:

an upper body having a first passage extending from a first end to second end;

a lower body having a second passage extending axially from a top end to a piston chamber, the lower body further comprising:

one or more gripping components, the gripping component being movable, relative to both the upper body and the lower body, responsive to a pressure applied via the first passage and the second passage; and one or more gripping component retainers;

a second lower body having a third passage extending axially from a second top end to a second piston chamber, the second lower body being removably coupled to the upper body via one or more fasteners, wherein the third passage aligns with the first passage when the second lower body is coupled to the upper body;

wherein the upper body is removably coupled to the lower body such that an interface is formed between the second end and the top end, the first passage and the second passage being aligned when the upper body is coupled to the lower body.

10. The wellbore tool kit of claim 9, wherein one or more dimensions of the second lower body are different from one or more dimensions of the lower body.

11. The wellbore tool kit of claim 9, wherein each of the lower body and the second lower body are particularly selected based, at least in part, on a mating tubing hanger.

12. The wellbore tool kit of claim 9, wherein both the lower body and the second lower body use a same set of fasteners to couple to the upper body.

13. The wellbore tool kit of claim 9, further comprising:

a rod extending through at least a portion of the upper body and the lower body, the rod being coupled to the one or more gripping components.

14. The wellbore tool kit of claim 13, further comprising:

a second lower body having a third passage extending axially from a second top end to a second piston chamber, the second lower body being removably coupled to the upper body via one or more fasteners, wherein the third passage aligns with the first passage when the second lower body is coupled to the upper body and the rod is coupled to one or more second gripping components of the second lower body when the second lower body is coupled to the upper body.

15. The wellbore tool kit of claim 9, wherein one or more fasteners to couple the lower body to the upper body are accessible through a bore.

16. The wellbore tool kit of claim 15, wherein the one or more fasteners are recessed into the lower body.

17. A wellbore system, comprising:

an upper body;

a first lower body, configured to removably couple to the upper body;

a second lower body, different from the first lower body, configured to removably couple to the upper body in place of the first lower body;

a passage extending through the upper body and through at least one of:

the first lower body when the first lower body is coupled to the upper body; or the second lower body when the second lower body is coupled to the upper body;

wherein the passage extends through an interface between the upper body and at least one of the first lower body or the second lower body;

a latch piston, confined to at least one of the first lower body or the second lower body, the latch piston being moveable responsive to an applied pressure via the passage, the latch piston moving relative to the upper body and relative to at least one of the first lower body or the second lower body; and a latch piston retaining ring, confined to at least one of the first lower body or the second lower body.

* * * * *